United States Patent [19]

Roe

[11] Patent Number: 5,038,670

[45] Date of Patent: Aug. 13, 1991

[54] PNEUMATIC CONTROL VALVE APPARATUS

[75] Inventor: Steven N. Roe, Los Altos, Calif.

[73] Assignee: Dynamic Valves, Inc., Palo Alto, Calif.

[21] Appl. No.: 506,328

[22] Filed: Apr. 9, 1990

[51] Int. Cl.[5] ..... F15B 13/043

[52] U.S. Cl. ..... 91/455; 91/461; 137/596.15; 137/596.16; 137/596.2; 137/625.18

[58] Field of Search ..... 91/455, 461; 137/596.14, 596.15, 596.16, 596.2, 625.18, 625.66

[56] References Cited

U.S. PATENT DOCUMENTS

| | | | |
|---|---|---|---|
| 2,393,805 | 1/1946 | Parker | 91/455 X |
| 3,580,281 | 5/1971 | Petersen . | |
| 3,587,640 | 6/1971 | Hanser | 137/896.14 X |
| 3,794,075 | 2/1974 | Stoll et al. | 137/625.66 |
| 3,878,765 | 4/1975 | Walters et al. . | |
| 3,884,266 | 5/1975 | Kondo | 137/625.27 |
| 3,906,980 | 9/1976 | Hanser | 91/455 X |
| 3,924,656 | 12/1975 | Hanser et al. | 137/596.16 X |
| 4,083,381 | 4/1978 | McClocklin et al. . | |
| 4,516,604 | 5/1985 | Taplin . | |
| 4,523,513 | 6/1985 | Gudat et al. . | |
| 4,535,810 | 8/1985 | Duder et al. | 137/596.17 |

*Primary Examiner*—Gerald A. Michalsky
*Attorney, Agent, or Firm*—Townsend and Townsend

[57] ABSTRACT

An improved pneumatic control valve apparatus which uses poppet valves as the primary valve components. The poppets are in a pair of poppet valve assemblies, each assembly containing a pair of spaced poppets on a shiftable shaft biased in one direction to cause the poppets to close respective valve seats and to open the valve seats when the shaft moves in the opposite direction. A roller diaphragm is used to couple the shaft to an adjacent support of the assembly. As the shaft moves in the opposite direction against a bias force, the roller diaphragms of each assembly flex in a rolling action to coordinate the movements of the poppets and the shaft. The poppets will simutaneously open their respective valve seats so that the same amount of fluid will flow through the valve seats and thereby assure precision movements of the shiftable parts of the work-producing device with which the poppet valve assemblies are coupled. The poppet valve assemblies of the present invention can be controlled by a control unit, such as a piezoelectric transducer operable as a function of the polarity and magnitude of a voltage applied to the transducer.

16 Claims, 3 Drawing Sheets

FIG.1
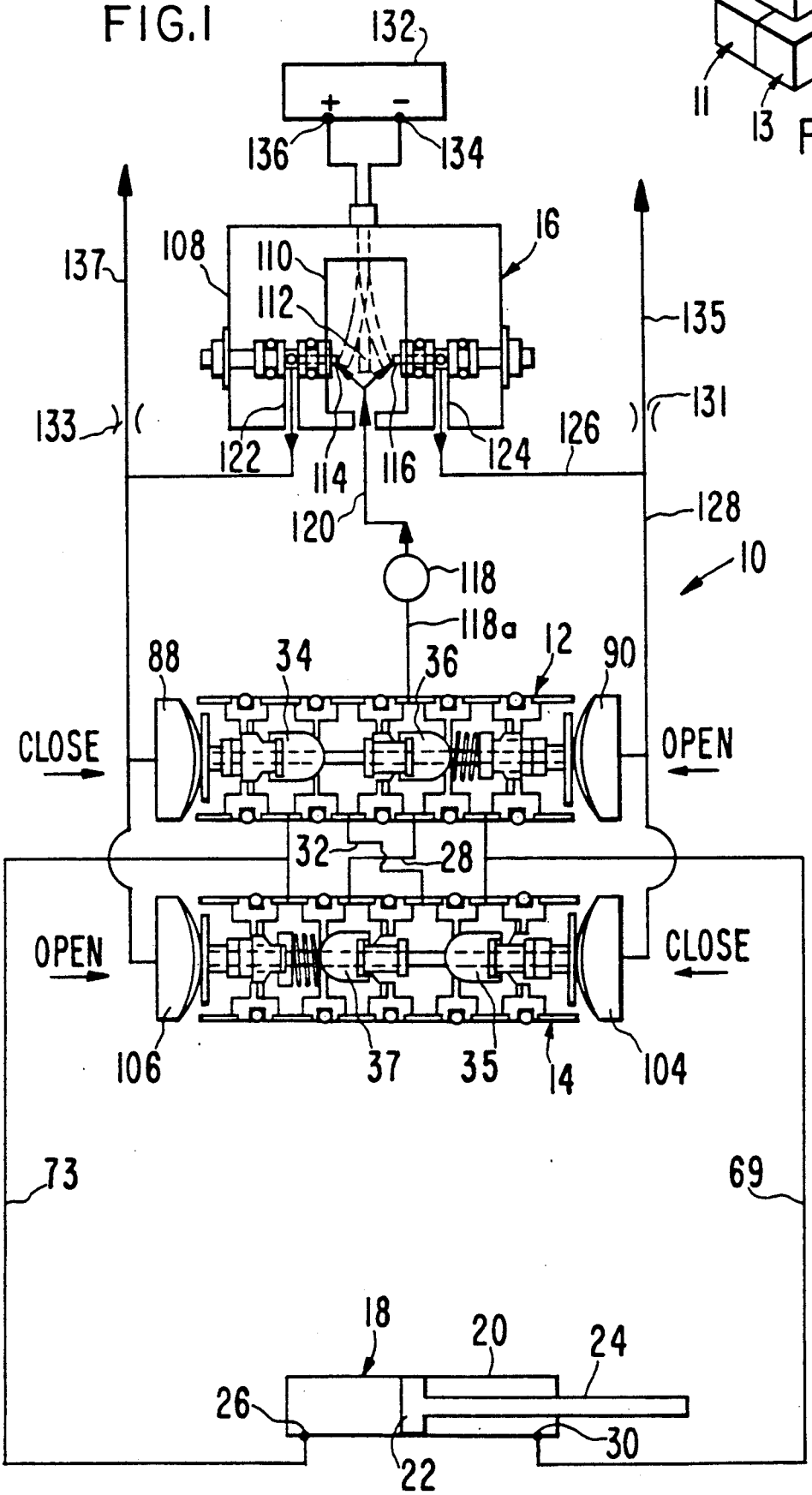
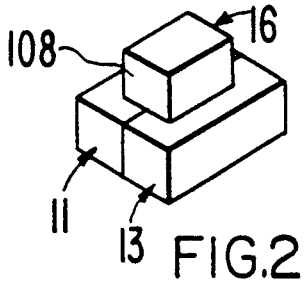
FIG.2

PNEUMATIC CONTROL VALVE APPARATUS

FIELD OF THE INVENTION

This invention relates to improvements in fluid actuated servocontrol valves and, more particularly, to a control valve assembly using poppets as the main valve components of the apparatus.

BACKGROUND OF THE INVENTION

Control valves of the three-way and four-way types typically use machined spools which are axially movable in a housing to control fluid flow along paths to and from a work-producing device. Such a device may be a fluid piston and cylinder assembly having a piston rod as the work-producing component. Disclosures of servocontrol values of this general type are set forth in the following U.S. Pat. Nos. 3,580,281; 3,878,765; 4,083,381, 4,516,604; and 4,523,513.

Control valves using shiftable spools are extremely expensive to manufacture because of the many machining steps which are required. The spools must be subjected to honing, lapping and fluid edge grinding, and material for such a spool must be a high grade, heat treated tool steel. Moreover, in use, a spool valve is in sliding contact with the metallic body having the bore in which the spool valve moves. This metal-on-metal contact gives rise to friction which militates against fast response time and precision movement of the spool valve. Also, the metal-to-metal contact over time causes wear of the spool valves which reduces the precision of the fluid edge tolerances, thereby giving rise to errors in the operation of the spool valves.

Because of the foregoing problems, there is a continued need for improvements in control valves, and the present invention is directed to a control valve assembly which avoids the problems mentioned above with respect to conventional control valves with machined spools.

SUMMARY OF THE INVENTION

The present invention is directed to an improved electro pneumatic control valve apparatus which uses poppet valves as the primary valve components. The control valve apparatus of the present invention can be used with valves of the three-way type or of the four-way type.

The poppets, in a preferred embodiment of the present invention, are provided in a pair of poppet valve assemblies, each assembly containing a pair of spaced poppets on a shiftable shaft which is biased in one direction to normally cause the poppets to close respective valve seats. The valve seats are opened when the shaft and the poppets move in the opposite direction.

An improved co-bonded roller diaphragm is used to couple each poppet, respectively, and the respective shaft to an adjacent support structure of the assembly, such as a support cylinder surrounding the shaft and having an 0-ring seal for engaging the inner surface of a housing in which the poppet valve assembly is mounted. An additional co-bonded roller diaphragm is provided near one end of a spring which biases the shaft in one direction so that, as the shaft moves in the opposite direction against the bias force of the spring, the three co-bonded roller diaphragms of each poppet valve assembly flex in a rolling action so as to enable the movements of the poppets and the shaft. A threaded control shaft provides adjustability of the poppets such that the poppets on the shaft will simultaneously open their respective valve seats to thereby assure that there will be the same amount of fluid flow through the valve seats and thereby assure precision movements of the shiftable parts of the work-producing device with which each of the poppet valve assemblies is coupled.

While the poppets and valve seats can be of metal, they do not require machining to precision tolerances as is required in the manufacture of precision spool valves. Moreover, the poppets themselves can be molded from a suitable synthetic material, such as nylon, and the roller diaphragms can be molded from a suitable resilient synthetic material, such as urethane rubber. The parts of each poppet valve assembly are such that the movements of the parts are near frictionless movements (provided by the roller diaphragm) and are pressure balanced. For normal operation, the stroke of the rolling part of each roller diaphragm is of the order of 0.025".

The poppet valve assemblies of the present invention can be controlled by a pilot control unit, such as a piezoelectric transducer, type which is operable as a function of the polarity and magnitude of a voltage applied to a shiftable part of the transducer. Such transducer can, therefore, control a pilot fluid which, in turn, can control the movements of the control shafts of the poppet valve assemblies. The movements of the shafts cause movements of the poppets which, in turn, give precision control of the fluid flow to and from a work-producing device, such as a fluid piston cylinder assembly having a shiftable piston rod as the work-producing component of the device.

The primary object of the present invention is to provide apparatus for controlling three-way and four-way precision control valves using poppets instead of conventional spool valves to avoid the expense of producing such conventional spool valves as well as to provide a frictionless assembly of parts which achieves precision in the control of the flow of fluid along fluid paths to and from a work-producing device.

Another object of the present invention is to provide a poppet valve assembly for use in apparatus for controlling fluid flow to and from a work-producing device wherein the poppet valve assembly has a relatively few number of parts which are out of frictional contact with each other and the parts are pressure balanced to provide for precise finite movements thereof to give precision control of the flow of a fluid to and from the work-producing device.

Still another object of the present invention is to provide a poppet valve assembly of the type described wherein co-bonded roller diaphragms are used to mount the poppets for movement toward and away from respective valve seats wherein the roller diaphragms are designed to roll instead of merely flexing so as to minimize or substantially eliminate any restriction to the movement of the poppets and the shafts on which the poppets are mounted.

Other objects of this invention will become apparent as the following specification progresses, reference being had to the accompanying drawings for an illustration of the present invention.

BRIEF DESCRIPTION OF THE DRAWINGS

FIG. 1 is a schematic view of the pneumatic control valve apparatus of the present invention;

FIG. 2 is a schematic view of the two poppet valve assemblies of the apparatus in block form together with a control unit;

DETAILED DESCRIPTION OF THE DRAWINGS

Figures 3, 5, 6, 7, 8:
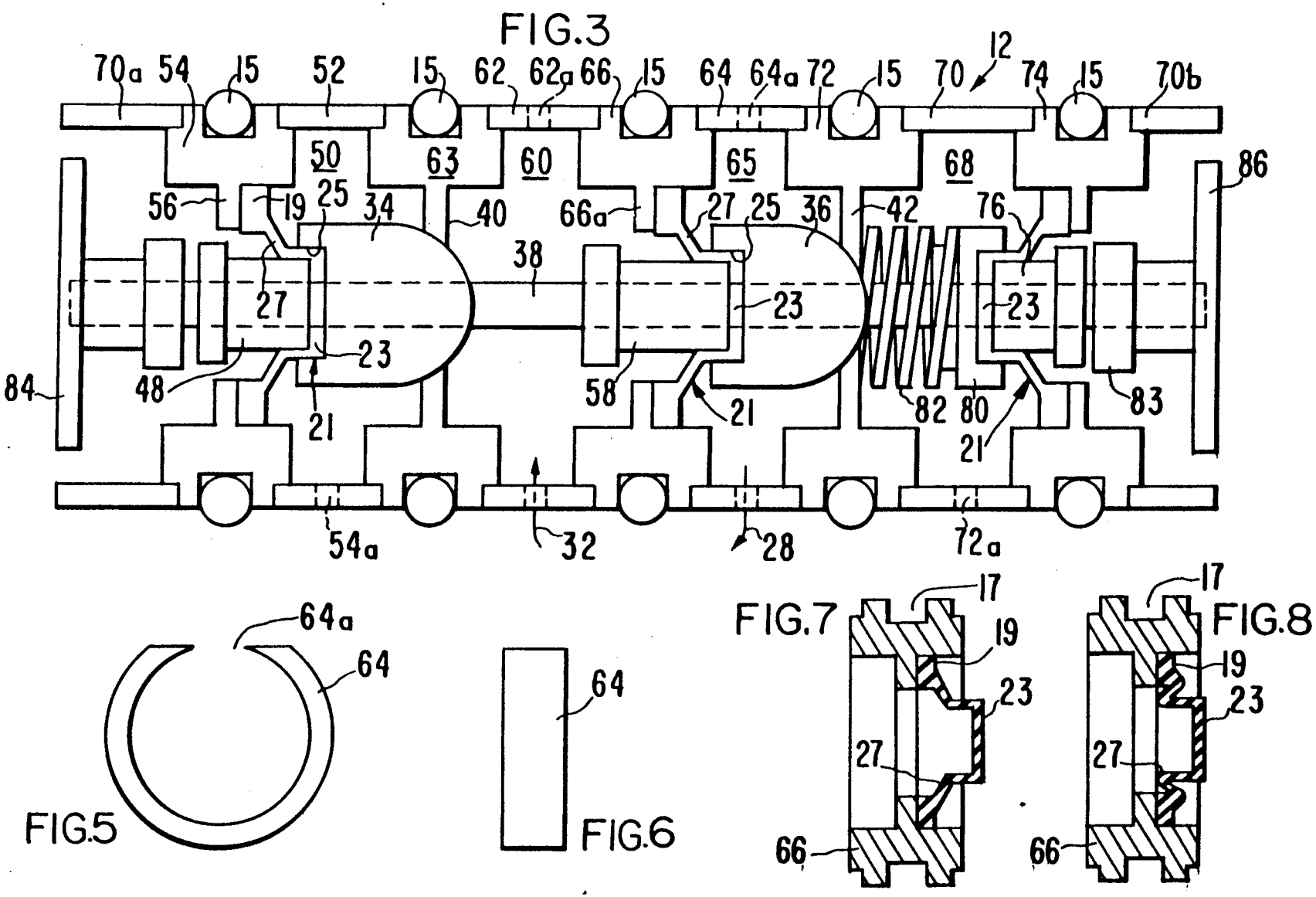
FIG. 3 is an enlarged, schematic view of one of two assemblies forming a part of the apparatus of FIG. 1.
FIGS. 5 and 6 are end and side elevational views of a ring which has been cut to present a port for one of the poppet valve assemblies.
FIGS. 7 and 8 are enlarged, fragmentary cross-sectional views of a diaphragm and its mount, showing the unflexed and flexed conditions of the diaphragm.

The apparatus of the present invention is broadly denoted by the numeral 10 and includes a pair of poppet valve assemblies 12 and 14 which are coupled to a control unit 16 for alternately supplying air under pressure to a work-producing device 18 in the form of a fluid piston and cylinder assembly having a cylinder 20, a piston 22, and a piston rod 24 as shown in FIG. 1. Cylinder 20 has a fluid port 26 on one side of piston 22, and has a fluid port 30 on the opposite side of piston 22.

When air under pressure is directed into cylinder 20 through port 26 under the control of poppet valve assembly 14, the air entering the cylinder 20 will force the piston 22 to the right when viewing FIG. 1. When this occurs, air is exhausted from cylinder 20 through port 30. Conversely, when air under pressure is directed into cylinder 20 through port 30 under the control of poppet valve assembly 12, the piston 22 is moved to the left when viewing FIG. 2, causing the exhaust of fluid from the cylinder through port 26. Thus, poppet valve assemblies work in parallel with each other, both under the control of control unit 16. Apparatus 10 is, therefore, provided to controllably supply air under pressure to cylinder 20 on opposite sides of piston 22 to thereby provide useful work with apparatus (not shown) coupled to the outer end of piston rod 24.

Poppet valve assemblies 12 and 14 are substantially the same in construction so that a description of one will suffice for a description of the other. Poppet valve assembly 12 is shown in FIG. 3 and includes a pair of poppets or poppet valve members 34 and 36 threadably mounted on a shaft 38 which is shiftable axially through a limited distance in opposed directions. Thus, poppets 34 and 36 are movable together as a unit when shaft 38 is moved.

Poppet 34 is associated with an annular valve seat 40, and poppet 36 is associated with an annular valve seat 42, each of the valve seats 40 and 42 having a central hole into which the adjacent poppet 34 or 36 projects as shown in FIG. 2 to close the valve defined by the poppet and the valve seat. FIG. 2 shows the valves in their closed positions.

Poppets 34 and 36 can be bullet-shaped and have substantially spherical end faces which engage and close the respective annular valve seats whose poppet-engaging surfaces are spherical so as to complementally engage, the end faces of respective poppets. The poppets can be formed of a suitable material, such as metal or synthetic plastic material.

Figure 4:
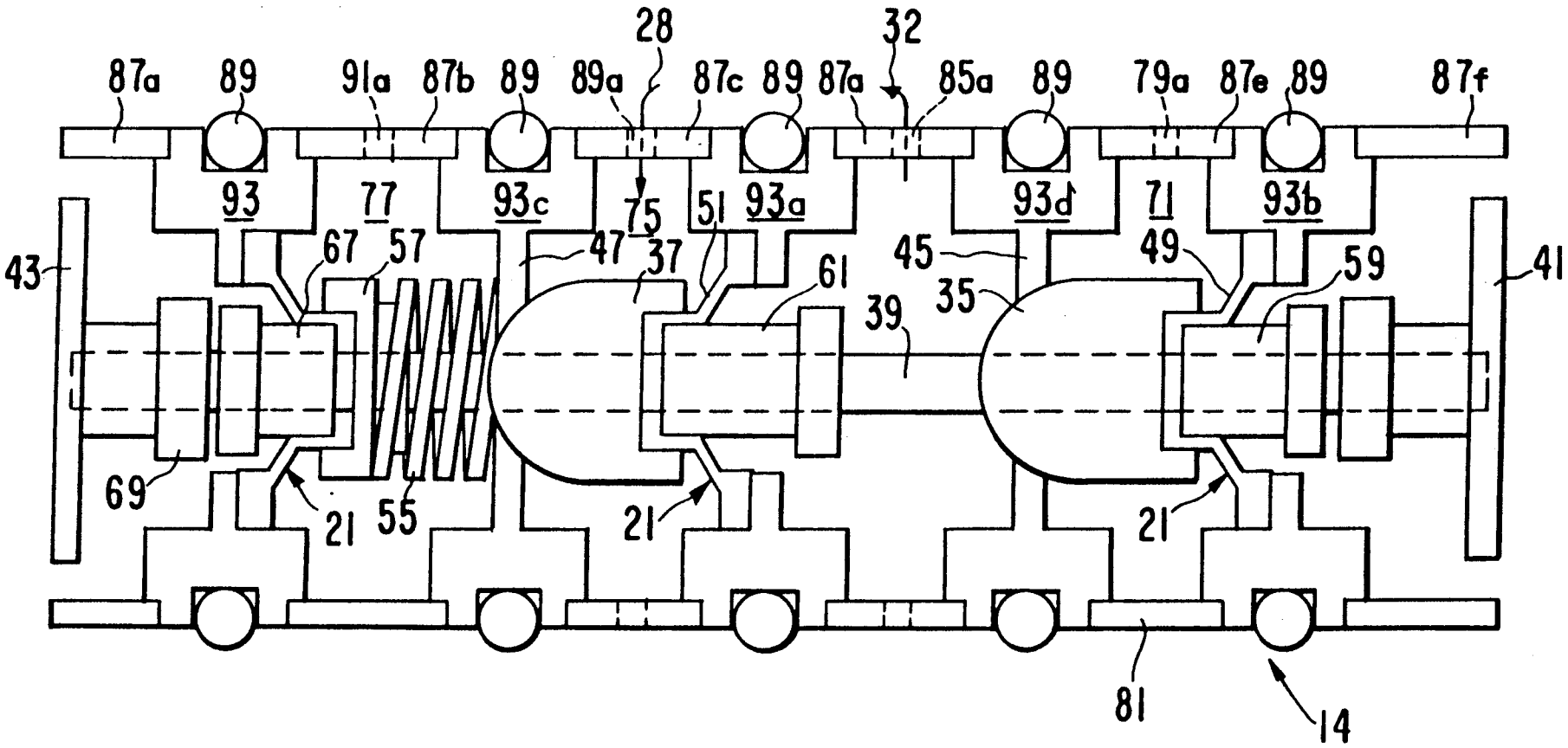
FIG. 4 is a view almost identical to FIG. 3 but showing the other, opposing poppet valve assembly of the apparatus.

Poppet valve assembly 12 further includes a number of spaced cylindrical members 54, 63, 66, 72 and 74. The cylinders are preferably of stainless steel, and the cylinders surround shaft 38 and are symmetrical with respect thereto. Moreover, the cylinders 54, 63, 66, 72 and 74 are separated by and are coupled to rings 52, 62, 64 and 70 which also surround shaft 38 and which are preferably of stainless steel. End rings **70*a* and 70*b* (FIG. 2) cooperate with the cylinders in the other ring to form a base structure for the assembly 12. This base structure is fitted into a bore of a housing 11 (FIG. 2) which receives poppet valve assembly 12, housing 11 being adjacent to housing 13 which has a bore for receiving poppet valve assembly 14 (FIG. 4). O-ring seals 15 are received in annular recesses 17 on the outer cylindrical surfaces of cylinders 54, 63, 66, 72 and 74. These O-rings bear against the inner surface of the bore of housing 11 in which the assembly 12** is removably received.

Cylinder 54 (FIG. 3) has an annular shoulder 56 which forms a base for engagement by the annular foot 19 of a co-bonded roller diaphragm 21 which has a cup-shaped element 23 received within a recess 25 of the corresponding poppet 34. A conical web 27 interconnects annular foot 19 with cup-shaped element 23, with the cup-shaped element 23 being adapted to receive a bushing 48 threaded onto shaft 38. Thus, roller diaphragm 21, along with two other roller diaphragms 21 to be described, effectively mounts the part of the shaft 38 adjacent to bushing 48 so that the shaft can move axially in opposed directions through a limited distance.

When shaft 38 is in the equilibrium condition of FIG. 3, diaphragm 21 is unflexed as shown in FIG. 7. However, when shaft 38 is moved to the left when viewing FIG. 3, the diaphragm rolls at the conical web 27 thereof as shown in FIG. 8.

Cylinder 63 near poppet 34 has an annular, radially extended projection defining valve seat 40, the projection having a central hole for receiving the adjacent spherical end of poppet 34, and the inner surface of the projection being for example a segment of a sphere so as to complementally engage the adjacent spherical outer surface portion of poppet 34 as shown in FIG. 3.

A second co-bonded roller diaphragm 21 is coupled to the annular shoulder **66*a* of cylinder 66 as shown in FIG. 2, and the cup-shaped element 23 of this roller diaphragm is received within a corresponding end recess of poppet 36. Element 23 engages a threaded bushing 58 on shaft 38. Thus, roller diaphragm 21 associated with poppet 36 effectively mounts the central portion of shaft 38 on cylinder 66 and is flexed in the manner shown in FIG. 8**.

Cylinder 72 (FIG. 3) may have, for example, an annular, radially extending projection which defines valve seat 42. The inner surface of the projection is a segment of a sphere to complementally engage the spherical outer surface of poppet 36 as shown in FIG. 2.

A third co-bonded roller diaphragm 21 is coupled with the annular, radially extending shoulder of cylinder 74 (FIG. 3), the foot 19 of the roller diaphragm 21 engaging the shoulder and the cup-shaped element 23 of the roller diaphragm being received within a recess of a transversely C-shaped washer 80 which bears against one end of a coil spring 82, end of the coil spring engaging valve seat support 42 as shown in FIG. 2. Coil spring 82 is under slight compression to bias the shaft 38 to the right when viewing FIG. 3, thus assuring that poppets 34 and 36 are normally closed.

The roller diaphragms 21 are important parts of poppet valve assembly 12 because of the way in which the roller diaphragms roll upon themselves (FIG. 8) as shaft 38 shifts axially to the left when viewing FIG. 3. Thus, the rolling action of the diaphragms minimizes or substantially eliminates any restriction on the movement of shaft 38. The shaft 38 is thus allowed to shift and thereby open the valves associated with poppets 34 and 36 and valve seats 40 and 42 at the same time, thus assuring coordination of movement of the poppets and to assure that the same amount of fluid will flow through the valve seats at all times when the valve seats are open. The conical configuration of web 27 of each roller diaphragm 21 contributes to this rolling action.

Each roller diaphragm is formed from a suitable elastomer, such as urethane rubber having a Durometer of 60 to 80, preferably about 70. The desired result of the coordinated movements of the poppets 34 and 36 are achieved even when the roller diaphragms operate with a stroke of approximately 0.025". Moreover, the use of the roller diaphragms 21 assures that there is essentially frictionless movement of the various parts of poppet valve assembly 12 so as to avoid the problems of friction encountered with conventional control valves using spools as the main valve elements.

The valve seats 40 and 42 and the three roller diaphragms 21 of assembly 12 define closed chambers 50, 60, 65 and 68 (FIG. 3). Any one of these chambers can be provided with a port formed by cutting the corresponding ring, such as ring 64 which is shown as being cut in FIGS. 5 and 6 to form a port 64*a*.

Follower pistons 84 and 86 are mounted on opposite ends of shaft 38. Control diaphragm 88 and 90 are associated with respective follower pistons 84 and 86 to exert a fluid pressures balance against the follower pistons as a function of the operation of pilot control unit 16.

Poppet valve assembly 14 (FIG. 3) has the same elements and is constructed the same as poppet valve assembly 12 (FIG. 2) except that the shaft 39 of assembly 14 is biased to the left instead of to the right when viewing FIG. 1. To this end, assembly 14 (FIG. 3) has poppets 35 and 37 threadably mounted on shaft 39 provided at the ends thereof with pistons 41 and 43 with which diaphragms 104 and 106 (FIG. 1) are associated. The poppets 35 and 37 have respective valve seats 45 and 47, and the shaft 39 is mounted by resilient co-bonded roller diaphragms 21 on the cylinders 93, 93*a* and 93*b* surrounding the shaft 39.

Valve seats 45 and 47 can be formed from annular projections on cylinders 93*c* and 93*d*. O-ring seals 89 are used to seal the resulting chambers 71, 73, 75 and 77 from each other when the cylinders 93, 93*c*, 93*a*, 93*d* and 93*b* are coupled with rings 87*a*, 87*b*, 87*c*, 87*d*, 87*e*, and 87*f* and the assembly 14 is in bore in housing 13 (FIG. 2). A coil spring 55 between slides compression between valve seat support 47 and a washer 57 biases shaft 39 to the left when viewing FIG. 3. Bushings 59, 61 and 67 are threadably mounted on shaft 39 to adjustably position poppets 35 and 37 and spring 55 on the shaft 39. A lock nut 69 adjustably holds the follower piston in place.

Control unit 16 is formed of a combination of elements generally described in U.S. Pat. No. 4,535,810. The control unit includes a housing 108 provided with a chamber 110 therein. A piezoelectric transducer or resilient strip 112 is carried in cantilever fashion by the housing 108 and extends into chamber 110 between fluid inlet ports 114 and 116. A source 118 of air under pressure is coupled by a line 120 to ports 114 and 116 to supply air under pressure thereto so that the air can flow through the outlets 122 and 124 as a function of the position of strip 112 with respect to inlets 114 and 116. For instance, if the blade is closer to inlet 114 than it is to inlet 116, the pressure at inlet 114 will be attenuated so that the pressure at port 116 will be greater than the pressure at port 114. Thus, a line 126 will direct air under the greater pressure by way of a fluid line 128 to diaphragm 90 and diaphragm 104 as shown in FIG. 1. When this occurs, shaft 38 of assembly 12 will move to the left when viewing FIG. 1, shifting poppets 34 and 36 and opening their valve seats 40 and 42. Simultaneously, the shaft 39 will remain in place as shown in FIG. 2 because the air pressure exerted on diaphragm 104 will continue to bias shaft 92 to the left when viewing FIG. 1.

Conversely, when strip 112 (FIG. 1) moves to the right when viewing FIG. 1, a greater pressure will exist at outlet 122 than will exist at outlet 124 so that the greater pressure will be directed along line 130 to diaphragms 88 and 106. The greater pressure will continue to bias shaft 38 to the right when viewing FIG. 1, keeping poppets 34 and 36 closed. However, the greater pressure exerted on diaphragm 106 will move the shaft 39 to the right when viewing FIG. 1, thus opening the valve seats 45 and 47 of poppets 35 and 37.

The deflection of piezoelectric strip 112 is effected by voltages provided by a voltage source 132 which has a positive output 134 and a negative output 136. When a positive voltage is applied to strip 112, the strip will move to the left when viewing FIG. 1. Conversely, when a negative voltage is applied to the strip, the strip will move to the right when viewing FIG. 1. Thus, the fluid pressure in lines 128 and 130 can be selectively controlled by the selective application of positive and negative voltages to strip 112.

In operation, assuming it is desired to perform work in which piston rod 24 of device 18 moves to the left when viewing FIG. 1, a positive voltage will be applied to piezoelectric strip 112 such that the strip will move to the left when viewing FIG. 1. This causes the fluid pressure of source 118 to be applied to a greater degree to inlet 116 so that outlet 124 will be at a higher fluid pressure than at outlet 122 of housing 108. The greater fluid pressure at outlet 124 is applied to line 128 which, in turn, is coupled with diaphragm 90 which is forced to the left when viewing FIG. 1 because the pressure exerted on diaphragm 90 is greater than the pressure exerted on diaphragm 88. Simultaneously, shaft 38 of assembly 12 will move to the left when viewing FIG. 1 against the bias force of coil spring 82, causing poppets 34 and 36 to move away from their valve seats 40 and 42 and opening the valve seats and placing chambers 65 and 68 in fluid communication with each other.

Opening the valve seat of poppet 36 causes pressure from source 118 to be directed along line 118*a* into and through port 64*a* (FIG. 3) and into chamber 65 and, because the adjacent valve seat 42 is open, the pressure is exerted in chamber 68 and through port 72*a*. The air under pressure from port 72*a* is directed along a line 69 coupled to the fluid port 30 of cylinder 20 of device 18 on the right hand side of piston 22 as shown in FIG. 1.

At the same time that chambers 65 and 68 are placed in fluid communication with each other, chambers 50 and 60 are placed in fluid communication with each other because poppet 34 is moved to the left when viewing FIG. 1. This causes an exhaust of the left hand chamber of cylinder 20 because port 26 of cylinder 20 is placed in fluid communication with chamber 50 by way of a line 73 which is coupled to port 54*a*. Port 62*a* is open to the atmosphere so that ports 54*a* and 62*a* (FIG. 3) are in fluid communication with each other when poppet 34 is open. Thus, the greater pressure in the right hand chamber of cylinder 20 causes the piston 22 and rod 24 to move to the left when viewing FIG. 1.

If it is desired to move piston 22 to the right, a negative voltage is applied to piezoelectric strip 112 to cause the strip to move to the left when viewing FIG. 1 so that the output pressure at outlet 122 is greater than the outlet pressure at outlet 124 of housing 108. Thus, the greater pressure at line 130 will continue to bias shaft 38 to the right when viewing FIG. 1 but will move the shaft 39 of poppet valve assembly 14 to the right, causing poppets 35 and 37 to open and to cause air pressure to be directed to fluid port 26 on the left hand side of the piston 22. This is achieved by coupling fluid source 118, to line 73 which, in turn, is coupled to inlet port 26.

Source 118 is coupled through chamber 65, line 28, port 89*a* (FIG. 4) chamber 75, the open valve seat 47 of poppet 37, port 91*a* (FIG. 4) and along line 73 to port 26. When this occurs, the right hand side of the cylinder 20 will be coupled at fluid port 30 by way of line 69, port 79*a*, chamber 71, the open valve seat 45 of poppet 35, chamber 73, port 85*a*, line 32, chamber 60, port 62*a* to the atmosphere for exhaustion.

The system of the present invention operates in a manner such that the poppets of one assembly 12 or 14 are fully closed before the poppets of the other assembly are opened i.e., assemblies move in independent yet synchronized manner.

The distance and speed by which piston rod 24 travels and thereby the amount of work that is performed by device 18 is a direct function of the polarity, and magnitude and duration of the voltage applied to piezoelectric strip 112. The main stage poppet displacement is linear and proportional to the original electrical input signal. When the piston rod 24 reaches its desired location, (applied voltage returned to zero) lines 128 and 130 will bleed through fixed orifices 131 and 133 to the atmosphere along lines 135 and 137. When this occurs, the coil springs in the poppet valve assemblies 12 and 14 will return the poppets to their closed positions to await the next displacement of a poppet shaft by way of a voltage applied to the piezoelectric strip transducer 112. The working pressures are in the range of 60 to 100 psi, normal shop air pressure ratings.

Work-producing device 18 is a linear actuator. It could be replaced by any other type of linear actuator, any type of rotary actuator, and a pneumatic motor. In any case, there will be a moving part and a fluid port on one side of the moving part and an fluid port on the opposite side of the moving part.

The poppets of assemblies 12 and 14 are adjustable axially of their respective shafts 38 and 39. The poppets are threadably mounted on the shafts typically using 2-56 machine screw threads; thus, for each clockwise revolution of the poppet, the poppet will advance 0.018 inch so as to provide precision linear adjustment of the poppets on the shafts. The poppets are provided with hexagonal flats which permit an adjustment tool to be coupled with the poppets to provide precise adjustments on the shafts. Pneumatic pressure is applied to the assemblies and sensed at the exit ports of respective chambers of the assemblies so as to calibrate and thereby accurately determine when the poppets are simultaneously closed and opened with respect to their valve seats. This is analogous to the precision fluid-edge grinding necessary for typical spool valve calibration.

I claim:

1. A fluid control apparatus for a fluid actuated work-producing device having a movable part with a pair of opposed sides and a pair of fluid ports on respective sides of the movable part comprising:

first and second poppet valve assemblies, each assembly having a housing and means in the housing for defining a pair of fluid passages, there being a shiftable poppet and a valve seat for each fluid passage, respectively, each assembly having a shiftable shaft coupling the respective poppets together to cause the poppets of each assembly to move together, a number of axially spaced, annular resilient roller diaphragms coupling each shaft, respectively, to the respective housing with the shaft extending along an axis of the housing, each diaphragm having a conical side wall operable to roll upon itself as a function of the axial movement of the respective shaft, each valve seat surrounding the respective shaft and each shaft being movable relative to the respective housing to cause the poppets of each assembly to move together with the respective shaft as a unit into and out of engagement with respective valve seats, each poppet being axially adjustable on the respective shaft to facilitate adjustment such that each poppet engages its respective valve seat at the same axial position of the common mounting shaft, one of the poppets of each assembly being located to open and close a first of said fluid passages of the respective assembly and the other poppet of the assembly being located to open and close the other fluid passage of the respective assembly;

means biasing each shaft, respectively, in a direction to urge the respective poppets toward the adjacent valve seats;

means for coupling a fluid pressure source to one of the fluid passages of each assembly, respectively;

means for coupling said one fluid passage of each assembly, respectively, to the fluid port on a respective side of the movable part of the device;

means for coupling the other fluid passage of each assembly, respectively, to the fluid port on the opposite side of the movable part of the device; and means including commonly ported endcap actuators for selectively controlling coordinated movements of the poppets of said assemblies, the shaft of one assembly being movable in one direction to open the respective valve seats and the shaft of the other assembly being movable in the opposite direction to open the respective valve seats of the other assembly to cause fluid pressure to be applied to a fluid port on one side of the movable part of the device as the fluid port on the opposite side of the movable part of the device is open to the atmosphere, whereby the movable part can be selectively moved.

2. Apparatus as set forth in claim 1, wherein the poppets of each assembly are coupled to the respective shaft at spaced locations thereon.

3. Apparatus as set forth in claim 1, wherein said bias means includes a coil spring surrounding the respective shaft.

4. Apparatus as set forth in claim 1, wherein the housing has an annular shoulder, one end of each diaphragm engaging the shoulder, the opposite end of the diaphragm being cup-shaped and coupled to the shaft.

5. Apparatus as set forth in claim 1, wherein is included a bushing coupled to and carried by each shaft, respectively for coupling the respective diaphragm to the shaft.

6. Apparatus as set forth in claim 1, wherein one of the diaphragms includes an elastomeric body, a washer surrounding the shaft, said body engaging the washer for supporting the shaft, said bias means including a coil spring between the washer and the adjacent valve seat, said coil spring being under compression.

7. Apparatus as set forth in claim 1, wherein each housing includes a number of spaced cylinders and a ring spanning the distance between and coupled with each pair of adjacent cylinders, respectively, the cylinders and the rings forming respective chambers in the assembly.

8. Apparatus as set forth in claim 7, wherein each poppet is surrounded by an adjacent cylinder, each adjacent cylinder having an annular projection extending radially inwardly toward the shaft, the inner periphery of the projection defining a valve seat engageable with the poppet adjacent thereto.

9. Apparatus as set forth in claim 8, wherein the inner peripheral surface of the projection is a segment of a sphere, and the outer surface of the corresponding poppet being generally spherical for complemental engagement with the inner peripheral surface of the projection.

10. Apparatus as set forth in claim 8, wherein the fluid passages of each assembly extend through respective valve seats.

11. Apparatus as set forth in claim 1, wherein said control means includes a piezoelectric transducer responsive to a voltage.

12. Apparatus as set forth in claim 11, wherein is included a voltage source having a negative voltage output and a positive voltage output, said outputs being coupled with the transducer to cause the transducer to shift in opposed directions as a function of the polarity and magnitude of the voltage applied thereto.

13. Apparatus as set forth in claim 1, there being a follower piston at each end, respectively, of each shaft, and a diaphragm coupled with each follower piston, respectively.

14. Apparatus as set forth in claim 13, wherein said control means has pilot means for directing a fluid flow under pressure into and toward a pair of fluid ports, said control means being operable to control the fluid pressure at said ports, said ports being coupled to the diaphragm and thereby the follower pistons and poppets of the assemblies to shift the poppets thereof in respective directions when the fluid source pressure is above a threshold value.

15. Apparatus as set forth in claim 1, wherein the assemblies are parallel with each other.

16. In a fluid control apparatus for a fluid actuated work-producing device having a movable part with a pair of opposed sides and a pair of fluid ports on respective sides of the movable part:

first and second poppet valve assemblies, each assembly having a housing and means in the housing for defining a pair of fluid passages, there being a shiftable poppet and a valve seat for each fluid passage, respectively, each assembly having a shiftable shaft coupling the respective poppets together to cause the poppets of each assembly to move together, a number of axially spaced, annular resilient roller diaphragms coupling each shaft, respectively, to the respective housing with the shaft extending along an axis of the housing, each diaphragm having a conical side wall operable to roll upon itself as a function of the axial movement of the respective shaft, each valve seat surrounding the respective shaft and each shaft being movable relative to the respective housing to cause the poppets of each assembly to move together with the respective shaft as a unit into and out of engagement with respective valve seats, each poppet being axially adjustable on the respective shaft, one of the poppets of each assembly being located to open and close a first of said fluid passages of the respective assembly and the other poppet of the assembly being located to open and close the other fluid passage of the respective assembly; and means biasing each shaft, respectively, in a direction to urge the respective poppets toward the adjacent valve seats, a fluid pressure source adapted to be coupled to one of the fluid passages of each assembly, respectively, said one fluid passage of each assembly, respectively, adapted to be coupled to the fluid port on a respective side of the movable part of the device, the other fluid passage of each assembly, respectively, adapted to be coupled to the fluid port on the opposite side of the movable part of the device.

* * * * *